US006584663B1

(12) United States Patent
Woodard et al.

(10) Patent No.: US 6,584,663 B1
(45) Date of Patent: Jul. 1, 2003

(54) CLUTCH INSTALLATION APPARATUS

(76) Inventors: Mayfield Woodard, 9700 Holly Springs Rd., Apex, NC (US) 27502; C. Kaye Woodard, 8105 Stephenson Rd., Apex, NC (US) 27502

( * ) Notice: Subject to any disclaimer, the term of this patent is extended or adjusted under 35 U.S.C. 154(b) by 0 days.

(21) Appl. No.: 10/023,413

(22) Filed: Dec. 14, 2001

(51) Int. Cl.[7] ..... B25B 27/14

(52) U.S. Cl. ..... 29/281; 29/281.5; 29/271; 29/281.6

(58) Field of Search ..... 269/46, 130–131; 254/133, 134; 29/281.5, 283, 281.6

(56) References Cited

U.S. PATENT DOCUMENTS

| | | | | | |
|---|---|---|---|---|---|
| 2,383,503 | A | * | 8/1945 | Landis et al. | 269/46 |
| 4,114,765 | A | * | 9/1978 | Kojima | 269/46 |
| 4,231,147 | A | | 11/1980 | Witt | |
| 4,768,741 | A | | 9/1988 | Logsdon | |
| 5,033,717 | A | | 7/1991 | Symon | |
| 5,290,019 | A | * | 3/1994 | Beyers | 269/46 |
| 5,295,291 | A | | 3/1994 | Harris | |
| 5,562,193 | A | | 10/1996 | Yamaguchi | |
| D411,086 | S | | 6/1999 | Bolin | |

* cited by examiner

*Primary Examiner*—Robert C. Watson

(57) ABSTRACT

A clutch installation apparatus for raising heavy clutch components facilitates mounting of the components to a bell housing. The clutch installation apparatus includes a mounting plate that is removably mountable to a bell housing. The plate has a pair of slots extending therethrough. Fastening members are utilized to secure the plate to the bell housing. A pair of posts is fixedly coupled to the front surface of the plate. A pair of spools is rotatably coupled to the front surface of the plate. A strap extends between and is fixedly coupled to the spools. The strap is removably wound about the spools. A pair of couplers removably couples the strap to the clutch component. A pair of guide pins is releasably extendable through apertures in the bell housing. A ratcheting means selectively prevents rotation in a first direction and allows rotation in a second direction.

20 Claims, 7 Drawing Sheets

CLUTCH INSTALLATION APPARATUS

BACKGROUND OF THE INVENTION

1. Field of the Invention

The present invention relates to clutch installation apparatuses and more particularly pertains to a new clutch installation apparatus for raising heavy clutch components to facilitate mounting of the clutch components to a bell housing.

2. Description of the Prior Art

The use of clutch installation apparatuses is known in the prior art. U.S. Pat. No. 4,231,147 describes a method and apparatus for installing and adjusting a clutches in automatic transmissions. Another type of clutch installation apparatus is U.S. Pat. No. 5,562,193 having a slidably movable member that may be extended between an outer surface of the plate and an outer surface of the release bearing, thereby measuring the distance between the two surfaces.

While these devices fulfill their respective, particular objectives and requirements, the need remains for a device that assists the user in raising the clutch component into a position in which it can be assembled.

SUMMARY OF THE INVENTION

The present invention meets the needs presented above by providing a means by which the heavy clutch component is coupled to and manually raised with ease.

Still yet another object of the present invention is to provide a new clutch installation apparatus that allows a single user to raise a heavy clutch component into a mounting position on the bell housing, with little or no assistance.

Even still another object of the present invention is to provide a new clutch installation apparatus that couples directly to the to portion of a wide variety of bell housings, and utilizes a universal method of attaching to the clutch component.

To this end, the present invention generally comprises a mounting plate that is removably mountable to the bell housing. The bottom edge of the plate has a generally concave arcuate shape to conform to the shape of the bell housing.

A pair of posts is fixedly coupled to the plate. The posts are positioned between the top edge and the bottom edge and spaced from each other. A longitudinal axis of the posts is substantially perpendicular to a plane of the plate. The posts are cylindrical and have a free end located opposite of the plate. The posts have a circumferential groove positioned nearer to the free end than the plate.

A pair of cylinders has a first end and a second end. Each of the first ends has a bore therein for receiving one of the posts such that the cylinders are rotatably positionable on the posts.

Each of the cylinders has a threaded hole passing therethrough from the outer surface to the bore. Each of a pair of retainer members is removably insertable and threadably couplable to one of the threaded holes. Each of the retainer members has a leading end and a trailing end. Each of the threaded holes are located such that the leading ends may extend into the grooves thereby releasably coupling the cylinders to the posts while allowing free rotation about the posts. The trailing ends partially protrude outwardly from the outer surface of the middle sections when the leading ends extend into the grooves.

Each of the second ends has a square aperture that extends therein and defines a female coupler for selectively receiving ratchet tools to be utilized to rotate the cylinders. A pair of splines is integrally coupled to the cylinders.

A pair of spools each has an opening extending therethrough for receiving one of the cylinders. Each of the openings has a notch therein for receiving the splines such that the spools rotate with the cylinders. Each of the spools is selectively positionable along the cylinders between the base section and the trailing ends of the retainer members.

A strap extends between and is fixedly coupled to the spools. The strap is removably wound about the spools.

A pair of belts has a first end and a second end. Each of the first ends is fixedly coupled to the plate. Each of the first ends are positioned adjacent to one of the cylinders. Each of the belts has a length generally equal to a circumference of the cylinders. The belts extend about and abut the outer surfaces of the cylinders.

Each of the cylinders has a first rotational direction and a second rotational direction. The first rotational direction is defined by an unwinding of the strap from the spools, and the second rotational direction is defined by a winding of the strap about the spools.

A biasing member is releasably attached to and extends between the second ends such that the belts are pulled taut against the cylinders.

The biasing member is contracted when the cylinders are rotated in the first direction such that the belts restrict rotation of the cylinders.

The biasing member is expanded when the cylinders are rotated in the second direction such that the belts permit rotation of the cylinders.

A pair of levers are rotatably coupled to the mounting plate and positioned adjacent to one of the first ends of the belts. Each of the levers is positioned generally in a plane oriented substantially parallel to the plane of the plate.

Each of the levers has a handle portion and a cam portion. Each of the cam portions abuts one of the second ends of the belts. Each of the levers are rotatable in such a manner that the cam portions may selectively bias the belts away from the outer surface of the base sections such that the biasing member is expanded and permits rotation of the cylinders in the first rotational direction.

A pair of couplers is designed for removably coupling the strap to the clutch component.

A pair of guide pins is releasably extendable through mounting holes in the bell housing such that a user may align the clutch component with the bell housing.

The user utilizes the ratchet tool to rotate the cylinders in the first direction while rotating the levers such that each of the belts are biased away from the outer surface of the cylinders, thereby allowing the extension of the strap downward until couplable to the couplers.

The user utilizes the ratchet tool to rotate the cylinders in the second direction such that the clutch component is raised upward into a mating position with the bell housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
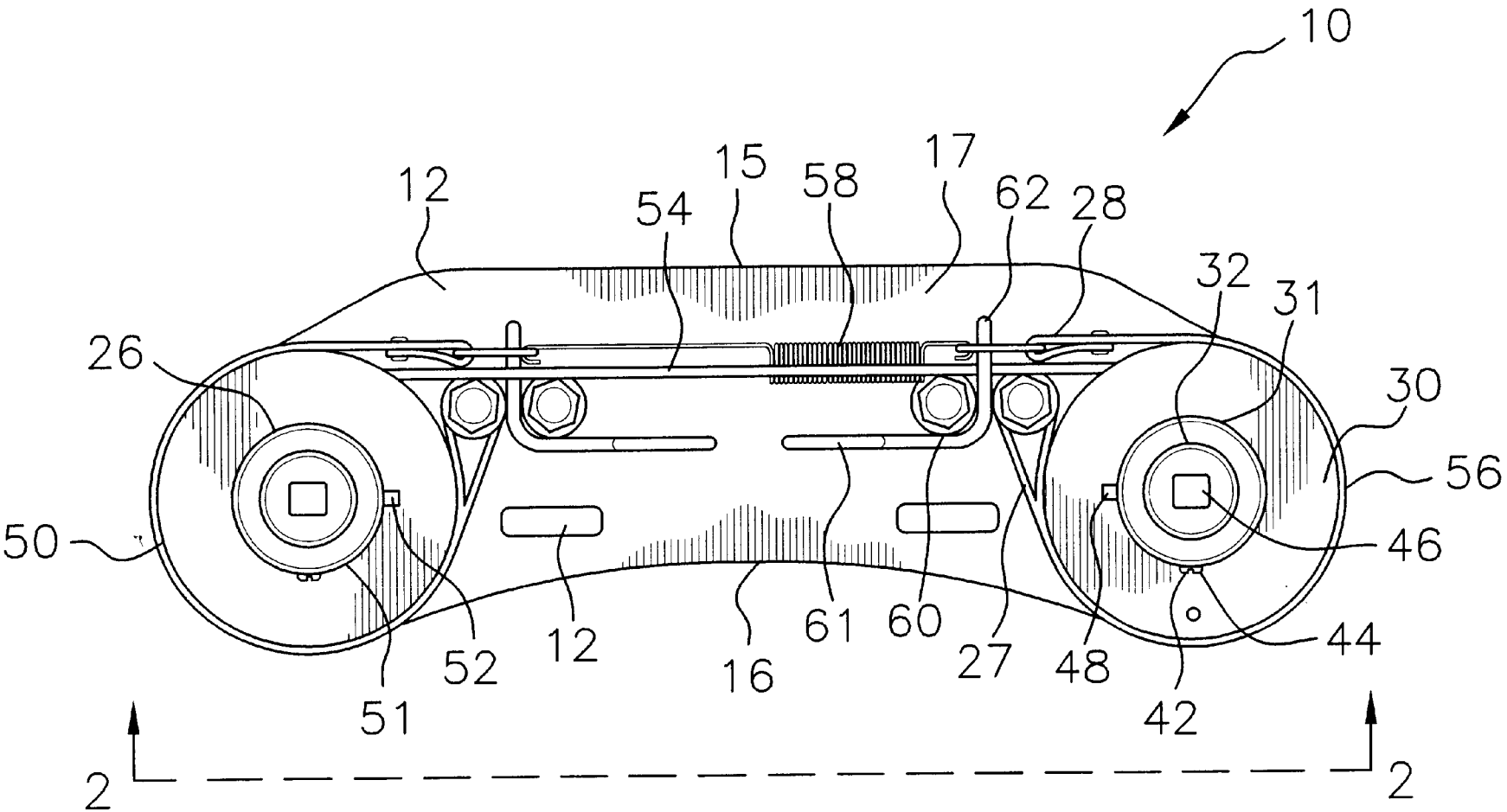
FIG. 1 is a schematic front view of a new clutch installation. apparatus according to the present invention.
Figure 2:
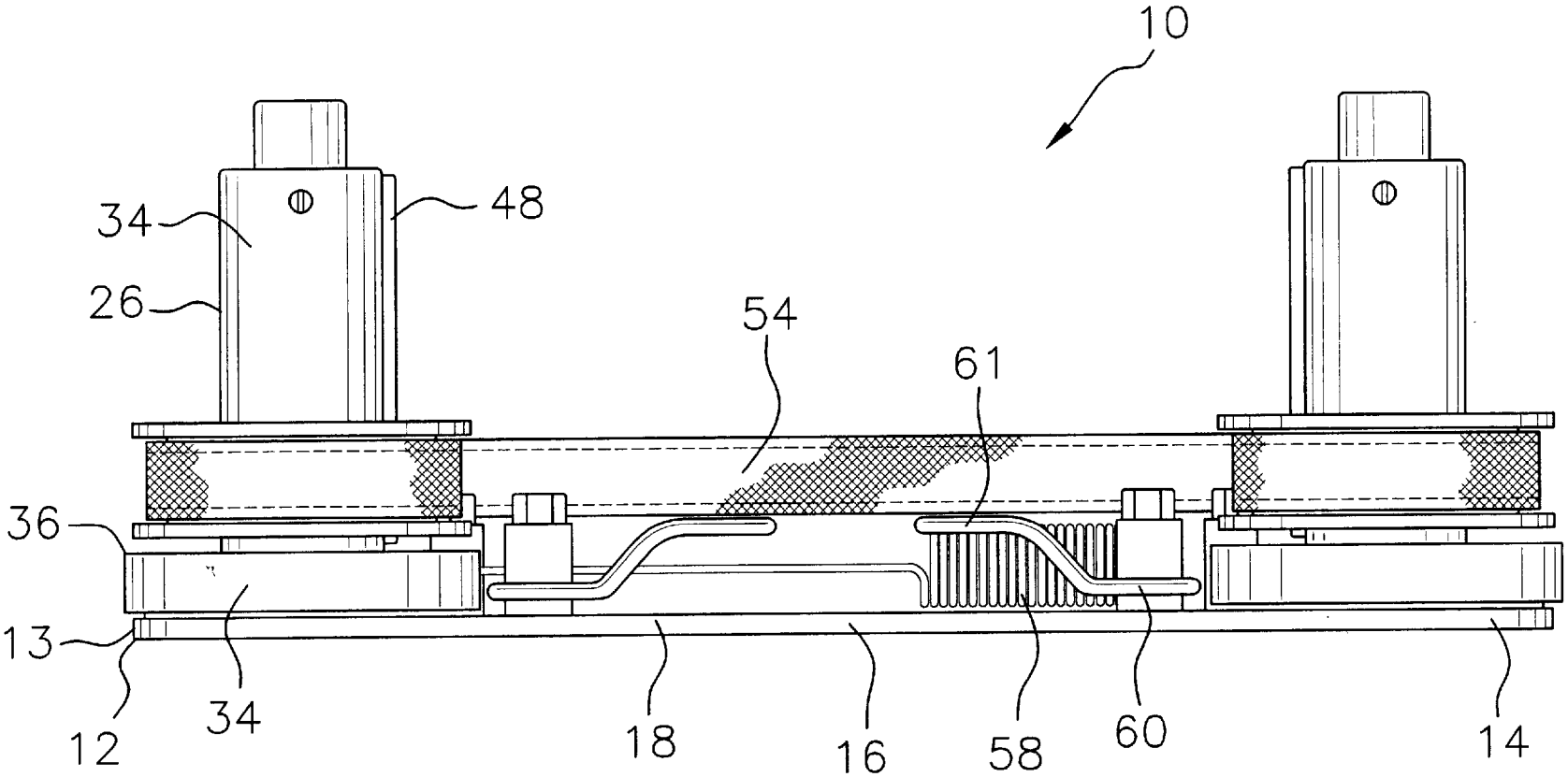
FIG. 2 is a schematic bottom view of the present invention with the spools in a inward position.
Figure 3:
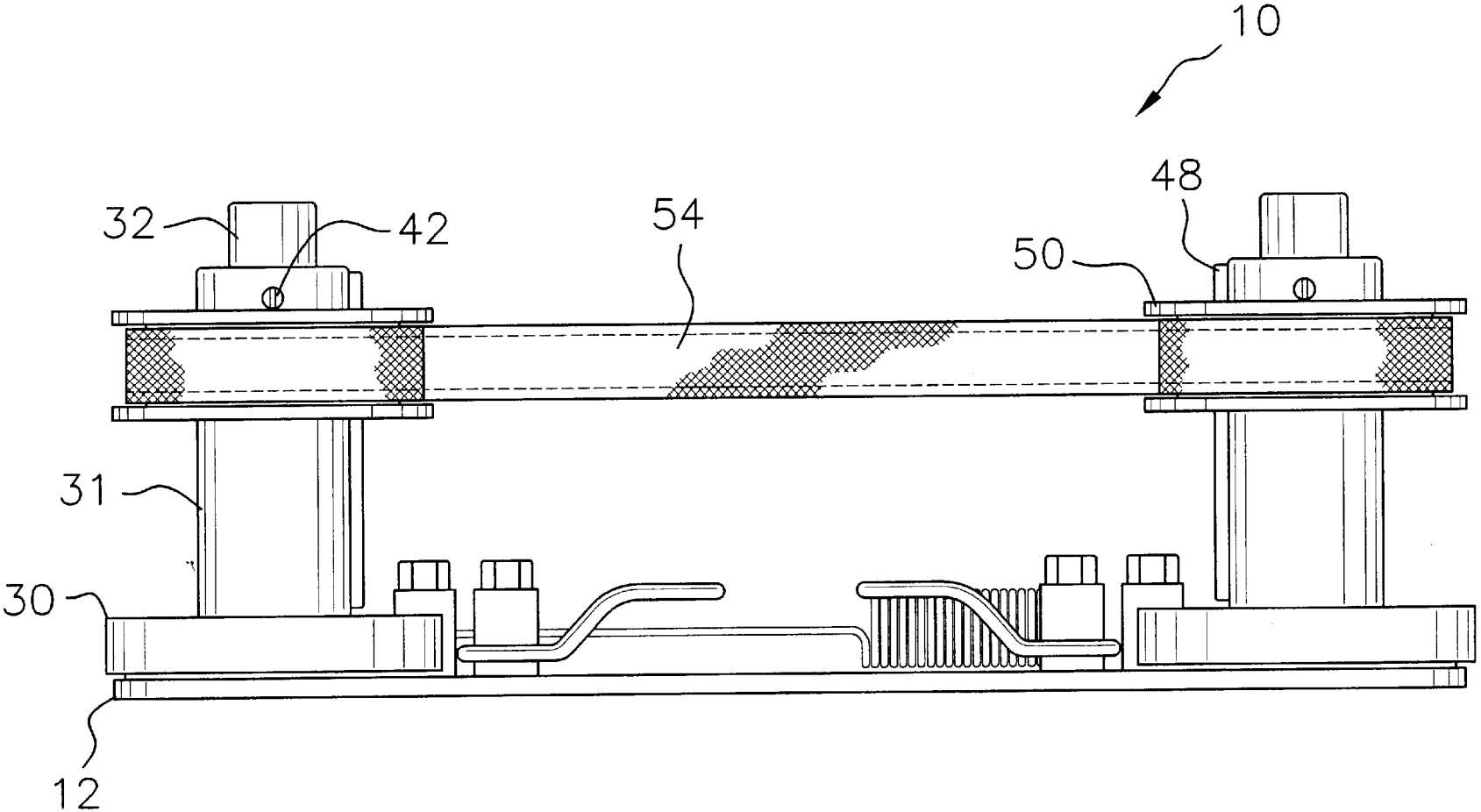
FIG. 3 is a schematic bottom view of the present invention with the spools in an outward position.
Figure 4:
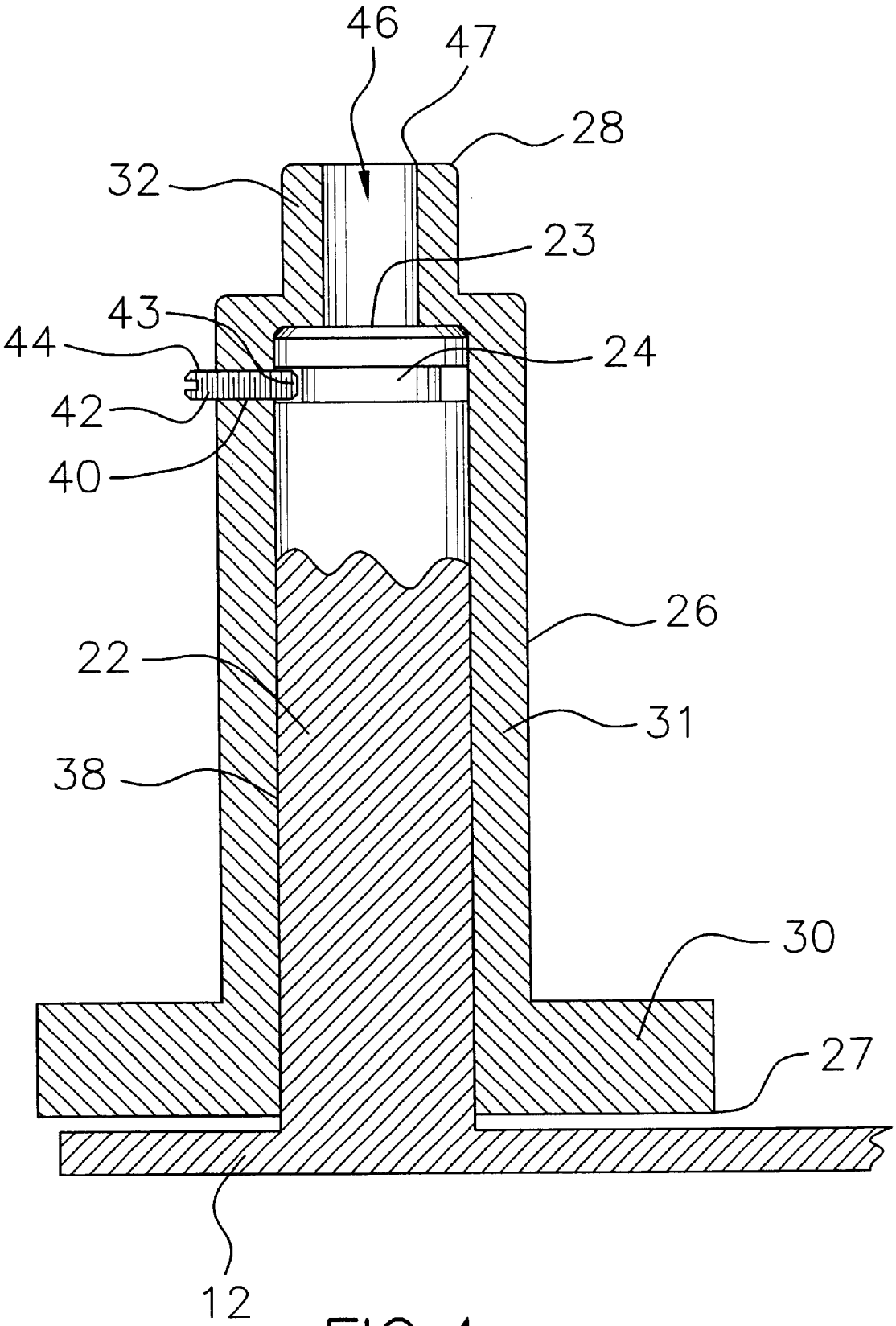
FIG. 4 is a schematic cross-sectional view of the plate, post, and cylinder of one end the present invention.
Figure 5:
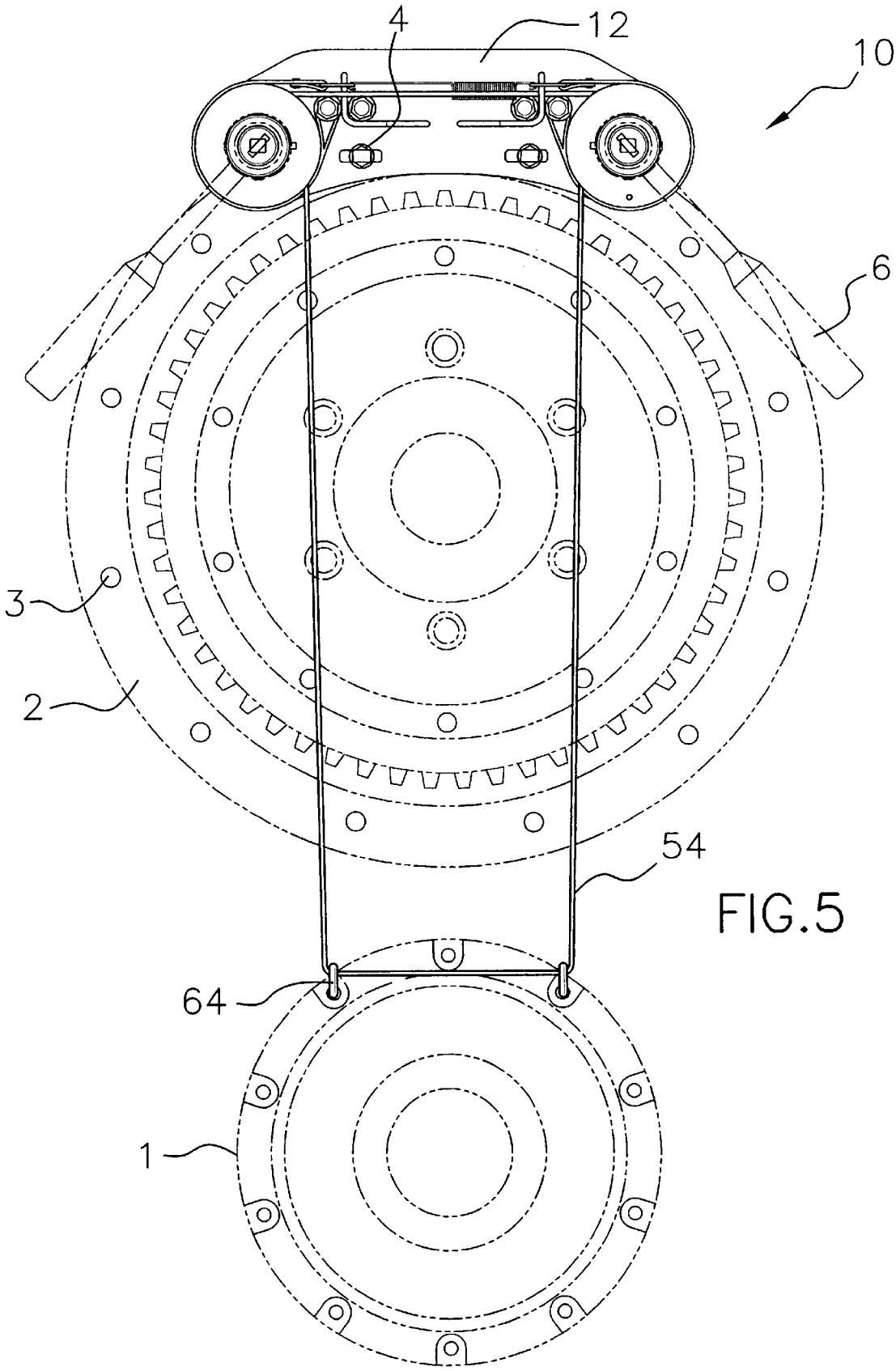
FIG. 5 is a schematic front view of the present invention with a clutch component coupled to the strap prior to raising.
Figure 6:
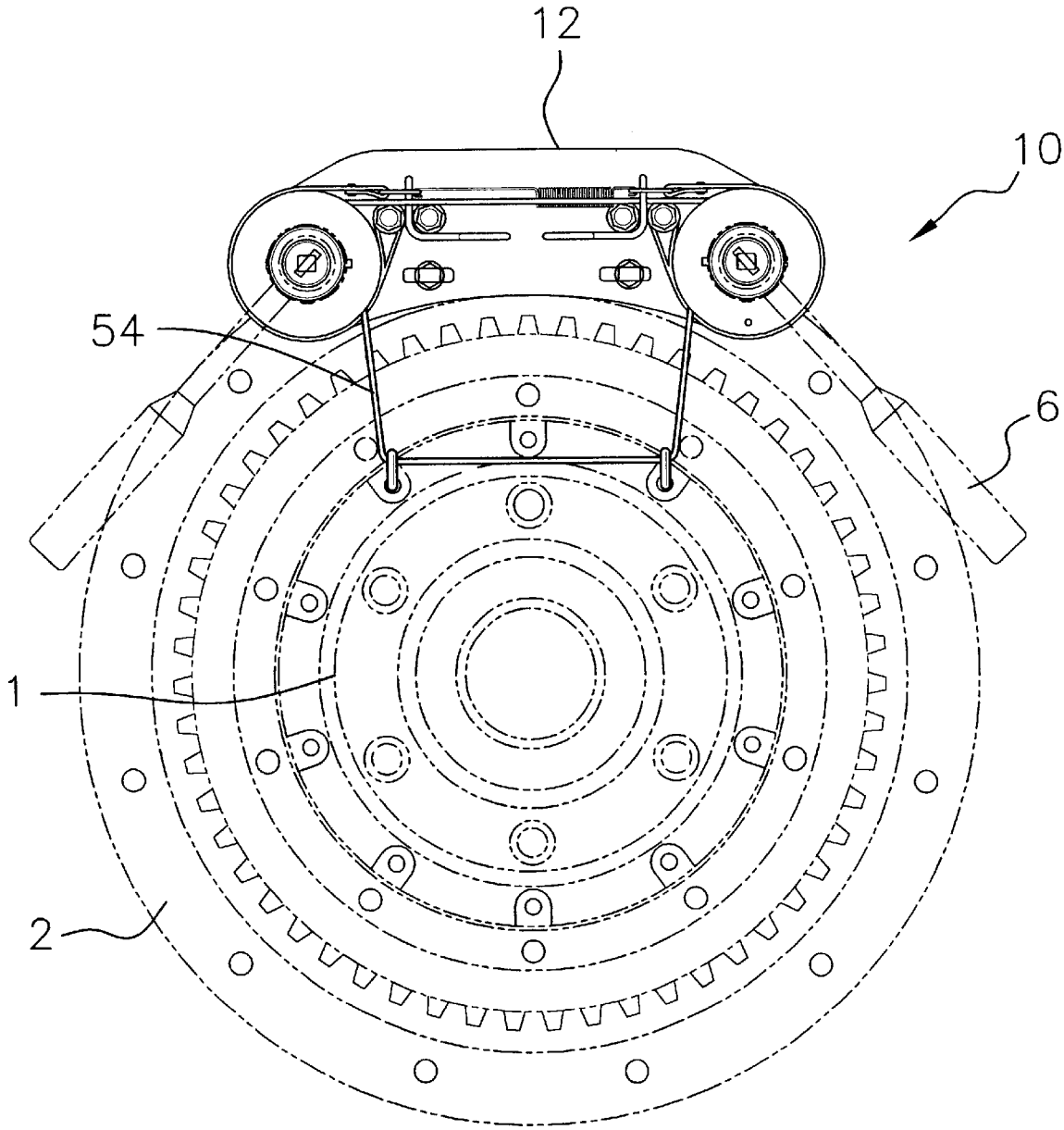
FIG. 6 is a schematic front view of the present invention with a clutch component coupled to the strap after raising into a mounting position.
Figure 7:
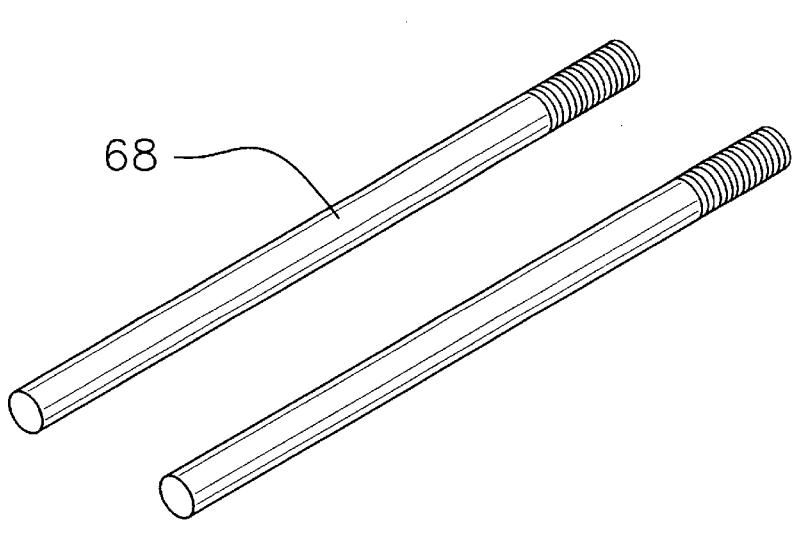
FIG. 7 is a schematic perspective view of a guide pin of the present invention.
Figure 8:
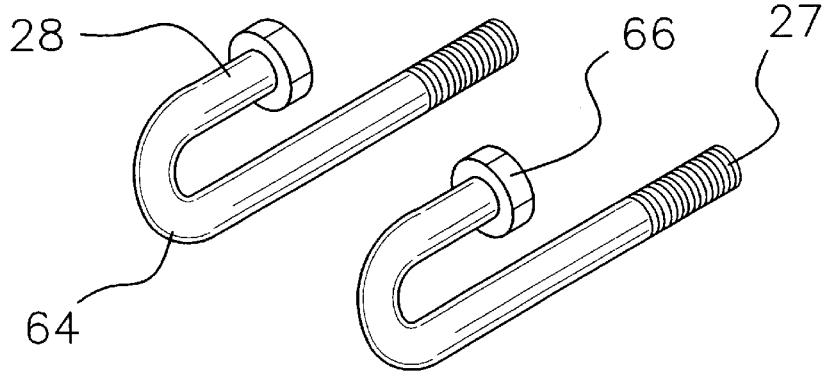
FIG. 8 is a schematic perspective view of a coupler of the present invention.

With reference now to the drawings, and in particular to FIGS. 1 through 8 thereof, a new clutch installation apparatus embodying the principles and concepts of the present invention and generally designated by the reference numeral 10 will be described.

As best illustrated in FIGS. 1 through 8, the clutch installation apparatus 10 generally comprises a mounting plate 12 that is removably mountable to the bell housing 2. The mounting plate 12 has a first side edge 13, a second side edge 14, a top edge 15, and a bottom edge 16. The bottom edge 16 has a generally concave arcuate shape. The plate 12 has a front surface 17 and a back surface 18.

The plate 12 has a pair of slots 20 extending therethrough. The slots 20 are positioned nearer to the bottom edge 16 than the top edge 15. The slots 20 are spaced from each other and positioned such that each is alignable with one of the apertures 3 in the bell housing 2. A pair of the fastening members 4 may be utilized to secure the plate 12 to the bell housing 2.

A pair of posts 22 is fixedly coupled to the front surface 17 of the plate 12. The posts 22 are positioned between the top edge 15 and the bottom edge 16 and spaced from each other such that the slots 20 are generally between the posts 22. A longitudinal axis of the posts 22 is substantially perpendicular to a plane of the front surface 17 of the plate 12. The posts 22 are cylindrical and have a free end 23 located opposite of the plate 12. The posts 22 have a circumferential groove 24 positioned nearer to the free end 23 than the plate 12.

A pair of cylinders 26 has a first end 27 and a second end 28, a base section 30, a middle section 31, and an end section 32. The base section 30 abuts the first end 27. Each of the base and middle sections 31 has an outer surface 34. The base sections 30 have a diameter greater than the middle sections 31 such that a shoulder 36 is defined at a juncture of each of the base sections 30 and a respective middle section 31.

Each of the first ends 27 of the cylinders 26 has a bore 38 therein that extends to a juncture of the middle and end sections 31, 32. Each of the bores 38 is designed for receiving one of the posts 22 such that the cylinders 26 are rotatably positionable on the posts 22. A length of the bores 38 is less than a length of the posts 22 such that the free ends 23 of the posts 22 abut the juncture of the middle and end sections 31, 32, thereby maintaining a space between the base sections 30 and the front surface 17 of the plate 12.

Each of the middle sections 31 has a threaded hole 40 passing therethrough from the outer surface 34 to the bore 38. Each of a pair of retainer members 42 is removably insertable and threadably couplable to one of the threaded holes 40. Each of the retainer members 42 has a leading end 43 and a trailing end 44. Each of the threaded holes 40 are located such that the leading ends 43 may extend into the grooves 24 thereby releasably coupling the cylinders 26 to the posts 22 while allowing free rotation about the posts 22. The trailing ends 44 partially protrude outwardly from the outer surface 34 of the middle sections 31 when the leading ends 43 extend into the grooves 24.

Each of the end sections 32 has a square aperture 46 that extends therein and defines a female coupler 47 for selectively receiving ratchet tools 6 to be utilized to rotate the cylinders 26.

A pair of splines 48 is integrally coupled to one of the middle sections 31 of the cylinders 26. Each of the splines 48 extend from one of the shoulder 36 sections to a respective one of the end sections 32.

A pair of spools 50 each has an opening 51 extending therethrough for receiving one of the middle sections 31 of the cylinders 26. Each of the openings 51 has a notch 52 therein for receiving the splines 48 such that the spools 50 rotate with the cylinders 26. Each of the spools 50 is selectively positionable along the cylinders 26 between the base section 30 and the trailing ends 44 of the retainer members 42.

A strap 54 extends between and is fixedly coupled to the spools 50. The strap 54 is removably wound about the spools 50.

A pair of belts 56 has a first end 27 and a second end 28. Each of the first ends 27 is fixedly coupled to the plate 12. Each of the first ends 27 of the belts 56 are positioned adjacent to one of the base sections 30 of the cylinders 26 and located nearer the top edge 15 than the bottom edge 16. Each of the belts 56 has a length generally equal to a circumference of the base sections 30. The belts 56 extend about and abut the outer surfaces 34 of the base sections 30 such that the second ends 28 are generally positioned adjacent to the first ends 27.

Each of the cylinders 26 has a first rotational direction and a second rotational direction. The first rotational direction is defined by an unwinding of the strap 54 from the spools 50, and the second rotational direction is defined by a winding of the strap 54 about the spools 50.

A biasing member 58 is releasably attached to and extends between the second ends 28 such that the belts 56 are pulled taut against the base sections 30.

The biasing member 58 is contracted when the cylinders 26 are rotated in the first direction such that the belts 56 restrict rotation of the cylinders 26.

The biasing member 58 is expanded when the cylinders 26 are rotated in the second direction such that the belts 56 permit rotation of the cylinders 26.

A pair of levers 60 are rotatably coupled to the mounting plate 12 and positioned adjacent to one of the first ends 27 of the belts 56. Each of the levers 60 is positioned generally in a plane oriented substantially parallel to the plane of the front surface 17 of the mounting plate 12.

Each of the levers 60 has a handle portion 61 and a cam portion 62. Each of the cam portions 62 abuts one of the second ends 28 of the belts 56. Each of the levers 60 are rotatable in such a manner that the cam portions 62 may selectively bias the belts 56 away from the outer surface 34 of the base sections 30 such that the biasing member 58 is expanded and permits a degree of rotation of the cylinders 26 in the first rotational direction.

A pair of couplers 64 is designed for removably coupling the strap 54 to the clutch component 1. Each of the couplers 64 comprises a threaded J-shaped hook that may be threadably coupled to the clutch component 1.

Each of the couplers 64 has a first end 27 and a second end 28. The first ends 27 are threadably couplable to the clutch component 1. The second ends 28 have an annular ridge 66 for retaining the strap 54.

A pair of guide pins 68 is releasably extendable through the apertures 3 in the bell housing 2 such that a user may align the clutch component 1 with the bell housing 2.

The user utilizes the ratchet tool 6 to rotate the cylinders 26 in the first direction while rotating the levers 60 such that each of the belts 56 are biased away from the outer surface 34 of the base portions, thereby allowing the extension of the strap 54 downward until couplable to the couplers 64.

The user utilizes the ratchet tool 6 to rotate the cylinders 26 in the second direction such that the clutch component 1 is raised upward into a mating position with the bell housing 2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A lifting apparatus for raising heavy clutch components to facilitate mounting of the components to a bell housing, the bell housing having a plurality of apertures therein for receiving fastening members, said apparatus comprising:

a mounting plate being removably mountable to the bell housing, said plate having a front surface and a back surface, said plate having a pair of slots extending therethrough, each being alignable with one of said apertures, wherein a pair of the fastening members may be utilized to secure said plate to the bell housing;

a pair of posts, each of said posts being fixedly coupled to said front surface of said plate;

a pair of spools, each of said spools being rotatably coupled to said front surface of said plate;

a strap extending between and being fixedly coupled to said spools, said strap being removably wound about said spools;

a pair of couplers for removably coupling said strap to the clutch component;

a pair of guide pins, each of said guide pins being releasably extendable through the apertures in the bell housing; and a ratcheting means for selectively preventing rotation in a first direction and allowing rotation in a second direction, wherein rotation in said second direction consists of an infinite number of steps.

2. The lifting apparatus as set forth in claim 1, wherein said mounting plate has a first side edge, a second side edge, a top edge, and a bottom edge, said bottom edge having a generally concave arcuate shape, each of said slots being positioned nearer to said bottom edge than said top edge.

3. The lifting apparatus as set forth in claim 2, further comprising each of said posts are positioned between said top edge and said bottom edge and spaced from each other such that said slots are generally between said posts, a longitudinal axis of said posts being substantially perpendicular to a plane of said front surface of said plate, said posts being cylindrical and having a free end located opposite of said plate, each of said posts having a circumferential groove positioned nearer to said free end than said plate.

4. The lifting apparatus as set forth in claim 1, said ratcheting means further including a pair of cylinders, each of said cylinders having a first end and a second end, a base section, a middle section, and an end section, wherein said base section abuts said first end, each of said base and middle sections having an outer surface, each of said base sections having a diameter greater than each of said middle sections such that a shoulder is defined at a juncture of each of said base sections and a respective middle section.

5. The lifting apparatus as set forth in claim 4, said ratcheting means further comprising each of said first ends having a bore therein extending to a juncture of said middle and end sections, each of said bores being adapted for receiving one of said posts such that said cylinders are rotatably positionable on said posts, wherein a length of said bores being less than a length of said posts such that said free ends of said posts abut a juncture of said middle and end sections, thereby maintaining a space between said base sections and said front surface of said plate.

6. The lifting apparatus as set forth in claim 5, said ratcheting means further including each of said middle sections having a threaded hole passing therethrough from said outer surface to said bore, each of a pair of retainer members being removably insertable and threadably couplable to one of said threaded holes, each of said retainer members having a leading end and a trailing end.

7. The lifting apparatus as set forth in claim 6, wherein each of said threaded holes is located such that each of said leading ends may extend into grooves in each of said posts thereby releasably coupling said cylinders to said posts while allowing free rotation about said posts, said trailing ends partially protruding outwardly from said outer surface of said middle sections when said leading ends extend into said grooves.

8. The lifting apparatus as set forth in claim 4, further comprising each of said end sections having a square aperture extending therein and defining a female coupler for selectively receiving ratchet tools to be utilized to rotate each of said cylinders.

9. The lifting apparatus as set forth in claim 4, further comprising a pair of splines, each of said spines being integrally coupled to one of said middle sections of said cylinders and extending from one of said shoulders to a respective one of said end sections.

10. The lifting apparatus as set forth in claim 6, said ratcheting means further including a pair of spools, each of said spools having an opening extending therethrough for receiving one of said middle sections of said cylinders, each of said openings having a notch therein for receiving splines positioned on said middle section such that said spools rotate with said cylinders, each of said spools being selectively positionable along said cylinders between said base section and said trailing ends of said retainer members.

11. The lifting apparatus as set forth in claim 4, said ratcheting means further including a pair of belts being positioned about each of said cylinders, each of said belts having a first end and a second end, each of said first ends being fixedly coupled to said plate, each of said first ends being positioned adjacent to one of said base sections of said cylinders and located nearer a top edge of said plate than a bottom edge of said plate, each of said belts having a length generally equal to a circumference of said base sections, said belts extending about and abutting said outer surfaces of said base sections such that said second ends are generally positioned adjacent to said first ends, wherein said biasing member being releasably attached to and extending between said second ends of each of said belts.

12. The lifting apparatus as set forth in claim 11, further comprising each of said cylinders having a first rotational direction and a second rotational direction, wherein said first rotational direction is defined by an unwinding of said strap from said spools and said second rotational direction is defined by a winding of said strap about said spools.

13. The lifting apparatus as set forth in claim 12, said ratcheting means further including a biasing member being releasably attached to and extending between said belts such that said belts are pulled taut against each of said cylinders, said biasing member being contracted when said cylinders are rotated in said first direction such that said belts restrict rotation of said cylinders, said biasing member being expanded when said cylinders are rotated in said second direction such that said belts permit rotation of said cylinders.

14. The lifting apparatus as set forth in claim 11, said ratcheting means further including a pair of levers for biasing each of said belts away from each of said cylinders, each of said levers being rotatably coupled to said mounting plate and positioned adjacent to one of said first ends of said belts, each of said levers being positioned generally in a plane oriented substantially parallel to a plane of said front surface of said mounting plate, wherein each of said levers having a handle portion and a cam portion, each of said cam portions abutting one of said second ends of said belts, each of said levers being rotatable in such a manner that said cam portions may selectively bias said belts away from said outer surface of said base sections such that said biasing member is expanded and permits rotation of said cylinders in said first rotational direction.

15. The lifting apparatus as set forth in claim 12, wherein each of said levers has a handle portion and a cam portion, each of said cam portions abutting one of said second ends of said belts, each of said levers being rotatable in such a manner that said cam portions may selectively bias said belts away from said outer surface of said base sections such that said biasing member is expanded and permits rotation of said cylinders in said first rotational direction.

16. The lifting apparatus as set forth in claim 1, wherein each of said couplers comprises a threaded J-shaped hook which may be threadably coupled to the clutch component, wherein each of said hooks having a first end and a second end, said first ends being threadably couplable to the clutch component, said second ends having an annular ridge for retaining said strap.

17. The lifting apparatus as set forth in claim 1, wherein each of said guide pins is adapted for allowing a user to align the clutch component with the bell housing.

18. The lifting apparatus as set forth in claim 12, wherein a user utilizes a ratchet tool to rotate said cylinders in said first direction while rotating said levers such that each of said belts are biased away from said outer surface of each of said base portions thereby allowing the extension of said strap downwardly until couplable to each of said couplers.

19. The lifting apparatus as set forth in claim 12, wherein a user utilizes a ratchet tool to rotate said cylinders in said second direction such that the clutch component is raised upwardly into a mating position with the bell housing.

20. A lifting apparatus for raising heavy clutch components to facilitate mounting of the components to a bell housing, the bell housing having a plurality of apertures therein for receiving fastening members, said apparatus comprising:

a mounting plate being removably mountable to the bell housing, said mounting plate having a first side edge, a second side edge, a top edge, and a bottom edge, said bottom edge having a generally concave arcuate shape, said plate having a front surface and a back surface, said plate having a pair of slots extending therethrough, said slots being positioned nearer to said bottom edge than said top edge, said slots being spaced from each other and positioned such that each is alignable with one of said apertures, wherein a pair of the fastening members may be utilized to secure said plate to the bell housing;

a pair of posts being fixedly coupled to said front surface of said plate, said posts being positioned between said top edge and said bottom edge and spaced from each other such that said slots are generally between said posts, a longitudinal axis of said posts being substantially perpendicular to a plane of said front surface of said plate, said posts being cylindrical and having a free end located opposite of said plate, said posts having a circumferential groove positioned nearer to said free end than said plate;

a pair of cylinders having a first end and a second end, a base section, a middle section, and an end section, wherein said base section abuts said first end, each of said base and middle sections having an outer surface, said base sections having a diameter greater than said middle sections such that a shoulder is defined at a juncture of each of said base sections and a respective middle section, each of said first ends having a bore therein extending to a juncture of said middle and end sections, each of said bores being adapted for receiving one of said posts such that said cylinders are rotatably positionable on said posts, a length of said bores being less than a length of said posts such that said free ends of said posts abut said juncture of said middle and end sections, thereby maintaining a space between said base sections and said front surface of said plate, each of said middle sections having a threaded hole passing therethrough from said outer surface to said bore, each of a pair of retainer members being removably insertable and threadably couplable to one of said threaded holes, each of said retainer members having a leading end and a trailing end, each of said threaded holes being located such that said leading ends may extend into said grooves thereby releasably coupling said cylinders to said posts while allowing free rotation about said posts, said trailing ends partially protruding outwardly from said outer surface of said middle sections when said leading ends extend into said grooves, each of said end sections having a square aperture extending therein and defining a female coupler for selectively receiving ratchet tools to be utilized to rotate said cylinders;

a pair of splines, each of said spines being integrally coupled to one of said middle sections of said cylinders, each of said splines extending from one of said shoulders to a respective one of said end sections;

a pair of spools each having an opening extending therethrough for receiving one of said middle sections of said cylinders, each of said openings having a notch therein for receiving said splines such that said spools rotate with said cylinders, each of said spools being selectively positionable along said cylinders between said base section and said trailing ends of said retainer members;

a strap extending between and being fixedly coupled to said spools, said strap being removably wound about said spools;

a pair of belts, each of said belts having a first end and a second end, each of said first ends being fixedly coupled to said plate, each of said first ends being positioned adjacent to one of said base sections of said cylinders and located nearer said top edge than said bottom edge, each of said belts having a length generally equal to a circumference of said base sections, said belts extending about and abutting said outer surfaces of said base sections such that said second ends are generally positioned adjacent to said first ends;

each of said cylinders having a first rotational direction and a second rotational direction, wherein said first rotational direction is defined by an unwinding of said strap from said spools and said second rotational direction is defined by a winding of said strap about said spools;

a biasing member being releasably attached to and extending between said second ends such that said belts are pulled taut against said base sections, said biasing member being contracted when said cylinders are rotated in said first direction such that said belts restrict rotation of said cylinders, said biasing member being expanded when said cylinders are rotated in said second direction such that said belts permit rotation of said cylinders;

a pair of levers, each of said levers being rotatably coupled to said mounting plate and positioned adjacent to one of said first ends of said belts, each of said levers being positioned generally in a plane oriented substantially parallel to the plane of said front surface of said mounting plate, each of said levers having a handle portion and a cam portion, each of said cam portions abutting one of said second ends of said belts, each of said levers being rotatable in such a manner that said cam portions may selectively bias said belts away from said outer surface of said base sections such that said biasing member is expanded and permits a degree of rotation of said cylinders in said first rotational direction;

a pair of couplers for removably coupling said strap to the clutch component, each of said couplers comprising a threaded J-shaped hook which may be threadably coupled to the clutch component;

wherein each of said hooks having a first end and a second end, said first ends being threadably couplable to the clutch component, said second ends having a annular ridge for retaining said strap;

a pair of guide pins, each of said guide pins being releasably extendable through the apertures in the bell housing such that a user may align the clutch component with the bell housing; and wherein the user utilizes the ratchet tool to rotate said cylinders in said first direction while rotating said levers such that each of said belts are biased away from said outer surface of said base portions thereby allowing the extension of said strap downwardly until couplable to said hooks; and wherein the user utilizes the ratchet tool to rotate said cylinders in said second direction such that the clutch component is raised upwardly into a mating position with the bell housing.

* * * * *